US009435111B2

(12) United States Patent
Cao et al.

(10) Patent No.: US 9,435,111 B2
(45) Date of Patent: Sep. 6, 2016

(54) PROCESS FOR MANUFACTURING PHYSICAL ASSETS FOR CIVIL AND/OR INDUSTRIAL FACILITIES ON MOON, MARS AND/OR ASTEROID

(75) Inventors: Giacomo Cao, Cagliari (IT); Alessandro Concas, Cagliari (IT); Massimo Pisu, Quartu Sant' Elena (IT); Roberto Orru', Cagliari (IT); Roberta Licheri, Quartu Sant' Elena (IT); Gianluca Corrias, Ardauli (IT); Claudio Zanotti, Treviglio (IT)

(73) Assignees: Università degli Studi di Cagliari Dipartimento di Ingegneria e Materiali, Cagliari (IT); A.S.I Agenzia Italiana Spaziale, Cagliari (IT)

( * ) Notice: Subject to any disclaimer, the term of this patent is extended or adjusted under 35 U.S.C. 154(b) by 20 days.

(21) Appl. No.: 13/812,472

(22) PCT Filed: Jul. 28, 2011

(86) PCT No.: PCT/IB2011/053369

§ 371 (c)(1),
(2), (4) Date: Jan. 25, 2013

(87) PCT Pub. No.: WO2012/014174

PCT Pub. Date: Feb. 2, 2012

(65) Prior Publication Data

US 2013/0118112 A1 May 16, 2013

(30) Foreign Application Priority Data

Jul. 29, 2010 (IT) ..... MI2010A1412

(51) Int. Cl.
*C22B 5/04* (2006.01)
*E21C 51/00* (2006.01)

(Continued)

(52) U.S. Cl.
CPC . *E04B 1/00* (2013.01); *C22B 5/04* (2013.01); *C22B 34/1209* (2013.01); *C22B 34/1277* (2013.01); *E21C 51/00* (2013.01)

(58) Field of Classification Search
CPC ..... C22B 5/04; E21C 51/00
USPC ..... 75/10.1, 10.48; 148/99
See application file for complete search history.

(56) References Cited

U.S. PATENT DOCUMENTS 3,470,276 A 9/1969 Ohno
4,938,946 A 7/1990 Gibson (Continued)

FOREIGN PATENT DOCUMENTS

CN 103643259 A * 3/2014 ..... C25C 3/06

OTHER PUBLICATIONS

Derwent Acc-No. 2014-J10563 for the patent family including CN 103643259 A by Gao et al published Mar. 19, 2014.*

(Continued)

*Primary Examiner* — George Wyszomierski
*Assistant Examiner* — Tima M McGuthry Banks
(74) *Attorney, Agent, or Firm* — LeClairRyan, a Professional Corporation

(57) ABSTRACT

A process for manufacturing physical assets for civil and/or industrial facilities on Moon, Mars and/or asteroid, as well as the kit of materials and apparatus for implementing the same. Such a kit allows in fact to implement the process of the invention by providing all materials and apparatus that will be applied on Moon, Mars and/or asteroid, thus advantageously and significantly reducing, either the costs and the volume and bulk of the materials. The process comprises the steps of enriching the regolite present in the soil in ilmenite or in iron oxides, then mixing it with aluminum powder and sending the resulting mixture to a reaction chamber for the obtention of constructive elements.

3 Claims, 4 Drawing Sheets

(51) Int. Cl.
*E04B 1/00* (2006.01)
*C22B 34/12* (2006.01)

(56) References Cited

U.S. PATENT DOCUMENTS

| | | | | |
|---|---|---|---|---|
| 4,948,477 | A * | 8/1990 | Gibson et al. | 205/629 |
| 5,128,003 | A | 7/1992 | Murdoch et al. | |
| 5,176,260 | A | 1/1993 | Oder | |
| 5,227,032 | A | 7/1993 | Sullivan | |
| 5,505,824 | A | 4/1996 | McElroy | |
| 5,536,378 | A | 7/1996 | Gibson et al. | |
| 6,076,216 | A | 6/2000 | Biryukov | |
| 2004/0055632 | A1 | 3/2004 | Mazumder et al. | |
| 2006/0185726 | A1* | 8/2006 | Rogers et al. | 136/292 |
| 2007/0017567 | A1 | 1/2007 | Gronet et al. | |
| 2009/0269273 | A1* | 10/2009 | Burton et al. | 423/579 |
| 2014/0165461 | A1* | 6/2014 | Cao | A01G 15/00 47/17 |

OTHER PUBLICATIONS

Blackman, Sarah. "The Moon Unearthed." Mining Technology. Kable, Mar. 18, 2011. Web. Nov. 3, 2014. <http://www.mining-technology.com/features/feature113053/>.*

Gao et al. Derwent Acc No. 2014-J10563 for the patent family including CN 103643259 A published Mar. 19, 2014. Abstract.*

Sridhar, K., et al., "Regenerative Solid Oxide Fuel Cells for Mars Exploration", Journal of Propulsion and Power, Nov.-Dec. 2000, Vo. 16, No. 6, pp. 1105-1111.

Schrunk D., et al., "The Moon, Resources, Future Development, and Settlement", Second Edition, Praxis Publishing, Springer, Feb. 11, 2012, 530 pgs.

Rapp D., "Human Missions to Mars, Enabling Technologies for Exploring the Red Planet", Praxis Publishing, Springer, 2008, pp. xv-502.

Katzan C., et al., "The Effects of Lunar Dust Accumulation on the Performance of Photovoltaic Arrays", Space Photovoltaic Research and Technology Conference (SPRAT XI), May 7-9, 1991, pp. 1-8.

Hickman J., et al., "Design Considerations for Lunar Base Photovoltaic Power Systems", 21st Photovoltaic Specialists Conferences, May 21-25, 1990, pp. 1-9.

Corrias G., et al., "Optimization of the self-propagating high-temerature process for the fabrication of situ of Lunar construction materials", Chemical Engineering Journal, 193-194 (2012), pp. 410-421.

* cited by examiner

PROCESS FOR MANUFACTURING PHYSICAL ASSETS FOR CIVIL AND/OR INDUSTRIAL FACILITIES ON MOON, MARS AND/OR ASTEROID

This application is a national stage application under 35 U.S.C. §371 of PCT Application No. PCT/IB 2011/053369, filed Jul. 28, 2011, which claims the benefit of Italy Patent Application No. MI2010A001412, filed Jul. 29, 2010, which is hereby incorporated by reference in its entirety.

FIELD OF THE INVENTION

The present invention concerns a process for manufacturing physical assets for civil and/or industrial facilities on Moon, Mars and/or asteroid, as well as the kit of materials and apparatus for implementing the same.

STATE OF THE ART

It is well known the NASA interest to undertake in the next 40 years human missions on asteroids, Moon and Mars. In particular, NASA has recently announced a mission to the Moon by 2020 and to Mars after 2030.

Specifically, within the framework of the current space exploration programs, the acronyms ISRU (In Situ Resource Utilization) and ISFR (In Situ Fabrication and Repair) are well known. The first acronym is related to the use of resources already available on Moon, Mars an/or asteroid, while the second one addresses the development of manufacturing maintenance and repair technologies, which allows longer human mission duration and cost reduction.

In this regard, processes for manufacturing physical assets for civil facilities of voussoir-type on Moon involving the use of lunar regolith and aluminum powders have been proposed (Faierson, E. J., "Demonstration of concept for fabrication of lunar physical assets utilizing lunar regolith simulant and a geothermite reaction", Acta Astronautica, 67 (1-2), 2010, 38-45). A mixture containing about 67% of regolith simulant JSC-1A or JSC-1AF, and 33% of aluminum, having particle size below 325 mesh, is placed inside a silica crucible of the desired shape. A current between 18 and 24 A which flows through a Ni—Cr filament, embedded in the mixture, allows to obtain, after 7-15 minutes, the final product. From said document it is possible to observe that the production of physical assets to obtain civil facilities of voussoir-type on Moon involves long reaction times and large quantities of aluminum powder. It should be also noted that the proposed fabrication process of physical assets to obtain civil facilities refers to voussoir-like facilities and is limited, exclusively, to lunar missions.

It is therefore felt the need to develop processes for obtaining physical assets not only for civil facilities but also industrial ones without the disadvantages described above.

SUMMARY OF THE INVENTION

The above mentioned object has been achieved by a kit of materials and apparatus for manufacturing physical assets for civil and/or industrial facilities on Moon, Mars and/or asteroid, comprising:

a) at least a photovoltaic panel, at least an electrolyser, at least a voltage transformer and at least a fuel cell based on hydrogen/oxygen cycle;

b) at least an excavator;

c) at least a separator:

i—for ion bombardment comprising at least a ionizing electrode consisting of a source of $Po^{210}$, and at least a static electrode; or ii—field induced comprising at least a rotor consisting of alternate ferromagnetic disks and non-magnetic material and at least one divider for particles separation;

d) at least a mixer; and e) at least a reaction chamber equipped with a sample holder and at least two electrodes, aluminum powder, at least a mould for the confiniment of the reaction mixture and at least an electrical resistance as trigger.

In another aspect, the present invention concerns a process for manufacturing physical assets for civil and/or industrial facilities on Moon, Mars and/or asteroid, the said process comprising the steps of:

1) providing the kit of materials and apparatus as indicated above on Moon, Mars and/or asteroid;
2) photovoltaically generating electricity;
3) extracting regolith from Moon, Mars and/or asteroid soil through excavation;
4) electrostatically enriching the Moon or asteroid regolith with ilmenite or magnetically enriching the Mars regolith with iron oxides;
5) mixing the so enriched minerals with aluminum powder;
6) inducing a self-propagating combustion reaction into the so obtained mixture by thermal triggering using an electrical resistance, thus obtaining physical assets; and
7) assembling physical assets to build civil and/or industrial facilities.

As it will be apparent from the following detailed description, the kit of materials and apparatus, as well as the process which employs it, allow to produce physical assets suitable for civil and/or industrial facilities on Moon, Mars and/or asteroid by advantageously using the in situ resources and thus facilitating both economically and operationally the set-up of the related missions.

BRIEF DESCRIPTION OF THE DRAWINGS

The characteristics and advantages of the present invention will be apparent from the following detailed description, as well as the working examples provided for illustrative and non limiting purposes, and the attached Figures wherein.

DETAILED DESCRIPTION OF THE INVENTION

Figure 1:
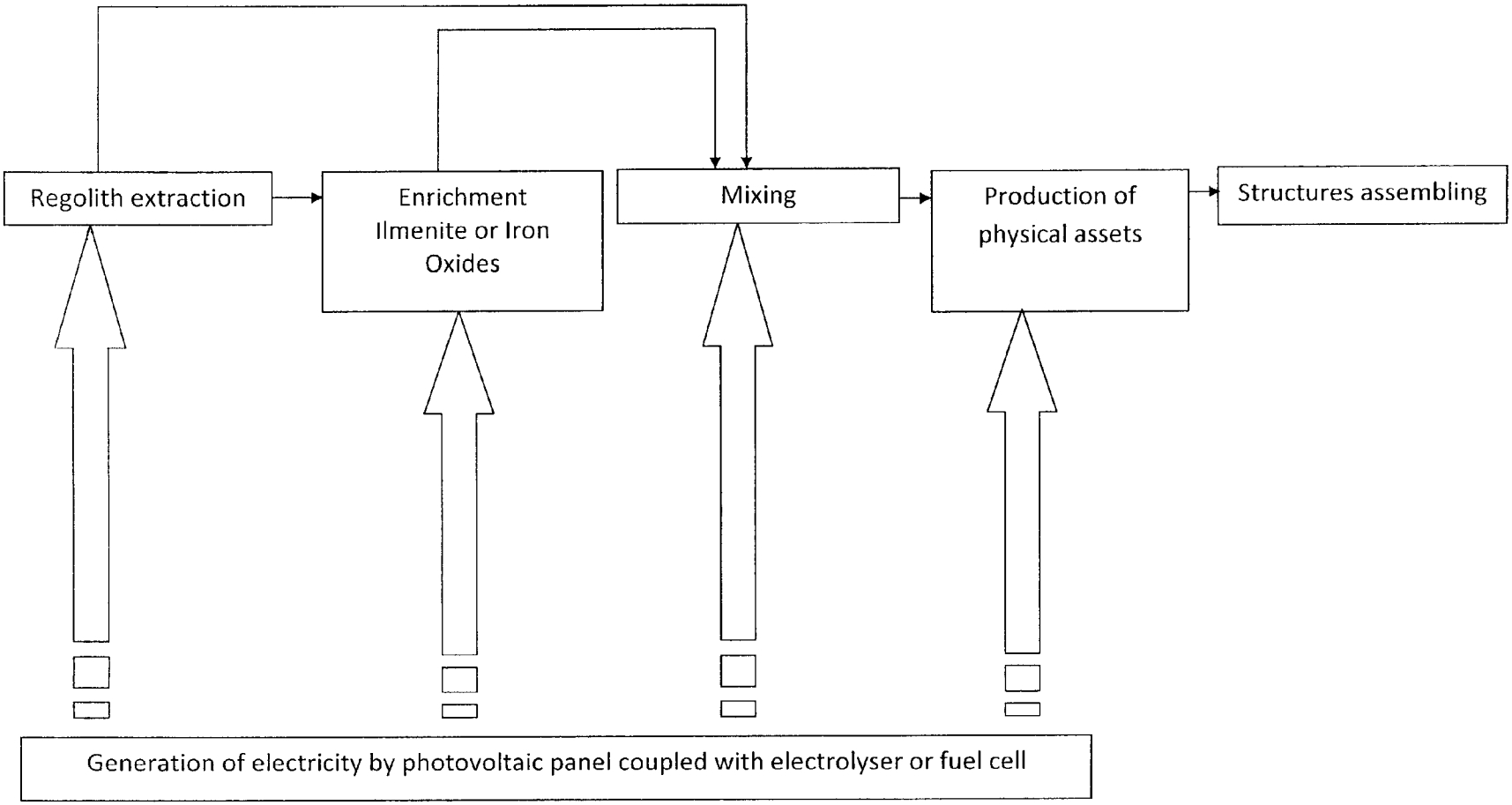
FIG. 1 shows a schematic representation of the process of the invention.

The subject of the present invention is therefore a kit of materials and apparatus for manufacturing physical assets for civil and/or industrial facilities on Moon, Mars and/or asteroid, comprising:

a) at least a photovoltaic panel, at least an electrolyser, at least a voltage transformer and at least a fuel cell based on hydrogen/oxygen cycle;

b) at least an excavator;

c) at least a separator:

i—for ion bombardment comprising at least a ionizing electrode consisting of a source of $Po^{210}$, and at least a static electrode; or ii—field induced comprising at least a rotor consisting of alternate ferromagnetic disks and non-magnetic material and at least one divider for particles separation;

d) at least a mixer; and e) at least a reaction chamber equipped with a sample holder and at least two electrodes, aluminum powder, at least a mould for the confinement of the reaction mixture and at least an electrical resistance as trigger.

As it will be apparent from the description of the present invention as well as from the Examples, the materials and apparatus of the kit allow to set-up all is needed to manufacture physical assets for civil and/or industrial facilities on Moon, Mars and/or asteroid, advantageously employing in situ resources, thus reducing both the costs and the volume and bulk of materials which are typically large during space missions.

According to a preferred embodiment, the kit of the present invention comprises:

a) for energy production and storage:

at least a photovoltaic panel, provided with at least one DCSU (Direct Current Switching Unit);

at least a regenerative technology fuel cell based on hydrogen/oxygen cycle and on the use of proton exchange membranes;

at least an electrolyser;

at least a dc-to-dc converter unit (DDCU);

at least a remote power control (RPC);

at least an output unit (OPs, Output Panels);

b) for extracting the regolith:

at least an excavator equipped with:

at least a power supply unit (having electrical power of at least 100 kW);

at least a battery charging unit connected to both the electric net and a photovoltaic panel installed on the excavator itself;

sensor auxiliary apparatus (accelerometer, amperometer);

automation and control auxiliary apparatus;

at least a transmitting/receiving data unit for remote control;

c1) for ilmenite enrichment from the Moon or asteroid regolith:

at least a ion bombardment separator;

at least a rotating drum;

at least a ionizing electrode consisting of a source of $Po^{210}$, and at least a static electrode;

at least a conveyor belt and hopper for regolith feeding;

automation and control auxiliary apparatus; or c2) for iron oxides enrichment from Mars regolith:

at least one field induced separator;

at least one rotor consisting of alternate ferromagnetic disks and non-magnetic material;

at least one divider for particles separation;

at least one conveyor belt and hopper for regolith feeding;

auxiliary equipment for automation and control;

d) for materials mixing obtained by steps which make use of the apparatus previously described:

at least one mixer having a horizontal-axis helix;

at least one conveyor belt and hopper for regolith feeding;

automation and control auxiliary apparatus;

aluminum powder;

e) for the combustion of the mixture:

at least one reaction chamber;

at least one mould for the confinement of the reaction mixture;

auxiliary apparatus for triggering the solid combustion reaction (transformer, electrodes, connectors, resistances);

at least a conveyor belt and hopper for regolith feeding;

automation and control auxiliary apparatus.

Preferably, said panel is a photovoltaic system having a surface of 3000 to 6000 $m^2$, more preferably about 4000 $m^2$, and extending on four surfaces perpendicular to each other, each surface being about 5 m×100 m of length. Photovoltaic panels are made of thin polymer membranes coated with a film of cells for producing electricity from solar radiation. Under the electrical point of view, said photovoltaic system is preferably divided into eight independent sections capable of providing 300 to 800 V, more preferably about 600 V. The energy produced during solar radiation is greater than 120 kW.

As far as the component b) is concerned, a suitable excavator can be that one described by Caruso, J J et al. "Cratos: A Simple Low Power Excavation and Hauling System for Lunar Oxygen Production and General Excavation Tasks," 2008 (http://ntrs.nasa.gov/archive/nasa/casi.ntrs.nasa.gov/20080005206_200800.pdf), which shows how it is possible to perform preliminary and auxiliary operations, such as regolith excavation and handling, by using a vehicle powered by photovoltaically rechargeable batteries (as per component a) of the kit) or independently by means of small photovoltaic systems housed on the same vehicle. As it will be apparent from the following description of the present invention, the electrical energy generated by the at least one photovoltaic panel is initially used to provide energy to the excavator for extracting the regolith from Moon, Mars and/or asteroid soil. The produced energy is then used for enriching regolith present on Moon or asteroid in ilmenite or the Martian one in iron oxides. The so enriched regolith is sent to a mixer for blending it with aluminum powder. The resulting mixture is conveyed to the reaction chamber from which the desired physical assets are obtained.

In another aspect, the present invention concerns a process for manufacturing physical assets for civil and/or industrial facilities on Moon, Mars and/or asteroid, comprising the steps of:

1) providing the kit of materials and apparatus as indicated above on Moon, Mars and/or asteroid;

2) photovoltaically generating electricity;

3) extracting regolith from Moon, Mars and/or asteroid soil by excavation means;

4) electrostatically enriching the Moon or asteroid regolith with ilmenite or magnetically enriching the Mars regolith with iron oxides;

5) mixing the so enriched minerals with aluminum powder;

6) inducing a self-propagating combustion reaction into the so obtained mixture by thermal triggering using an electrical resistance, thus obtaining physical assets; and 7) assembling physical assets to build civil and/or industrial facilities.

The step 1) of the process according to the present invention provides the kit of materials and apparatus as described above on the Moon, Mars and/or on asteroid. This step is performed through a space mission from the Earth in order to transport all the necessary materials and apparatus to implement subsequent steps of the process, namely the manufacturing of physical assets for civil and/or industrial facilities on Moon, Mars and/or asteroid.

It should be understood that all the aspects identified as preferred and advantageous for the kit are accordingly considered to be preferred and advantageous also for the process of the present invention.

The step 2) of the process according to the present invention consists of generating electricity by means of at least one photovoltaic panel of the kit, as shown in FIG. 1. In particular, with respect to the component a) of the kit, said at least one photovoltaic panel provides energy to at least one electrolyser which, due to said electric contribution, is able to perform water electrolysis to produce hydrogen, which is stored and in turn used for feeding the at least one fuel cell. Thus, the extraordinary advantage is achieved to exploit the electrical current provided by at least one photovoltaic panel, through the use of hydrogen, at any time, even during period of darkness. The obtained energy is then used to sustain the subsequent steps of the process, if required.

The step 3) of the present invention envisages the extraction of regolith from Moon, Mars and/or asteroid by excavation, in particular by using the excavator of the component b) of the kit.

The step 4) of the present invention envisages the electrostatical enrichment of Lunar or asteroid soil in ilmenite or the magnetical enrichment of Martian soil in iron oxides. Ilmenite is a titanium-iron oxide mineral ($FeTiO_3$) with similar structure of hematite, with which is isomorphic.

As far as the enrichment of lunar or asteroid regolith in ilmenite is concerned, electrostatic technologies are used for minerals separation, involving the application of a suitable potential difference to the electrodes in order to obtain a value of electric field of about 5 kV/cm useful for the minerals separation. It has been observed that in this way it is possible to effectively separate the ilmenite from the regolith, with satisfactory yields depending on the particle size.

Said enrichment in ilmenite of lunar or asteroid soil is implemented by using the component c1) of the kit described above, in particular by using an ionic bombardment separator constituted by a $Po^{210}$ source, at least one ionizing electrode and at least one static electrode.

As far as the enrichment in iron oxides of the Martian regolith is concerned, minerals are separated using magnetic technologies which are based on the induction of an electric charge on the particles through the application of an appropriate magnetic field. The charged particles are separated on the basis of a different tendency to retain or dispose the acquired charge.

Said enrichment in iron oxides of the Martian soil is implemented by using the component c2) of the kit described above, in particular by using an induced field separator comprising at least one rotor consisting of alternate ferromagnetic disks and non-magnetic material and at least one divider for particles separation.

The step 5) envisages the mixing of regolith enriched in ilmenite or iron oxide with aluminum powder.

Preferably, such a mixing is carried out within the following weight ratios:

- 75-78% lunar or asteroid regolith enriched in ilmenite at 40-66%, and 22-25% aluminum powder, or
- 80-85% Martian regolith enriched in iron oxides at 45-65%, and 15-20% aluminum powder.

The step 6) envisages the induction of a self-propagating high temperature combustion reaction on the mixture resulting from step 5) by ignition using an electrical resistance. During such reacting processes, the reaction self-propagates upon ignition in the form of a combustion wave which travels through the reacting powders without requiring additional energy. Indeed, these aspects are extremely important from the practical point of view since the process permits to obtain solid final products characterized by extremely good purity and mechanical properties by means of a very simple reaction which needs a quite low external electrical contribution.

The powder mixture coming from step 5), optionally compacted, is placed into the reaction chamber under an electric ignition source, preferably consisting of a tungsten coil, which is placed about 2 mm far from the mixture. The ignition temperature is obtained by an electric current, generated by a potential difference, which flows through the electrical resistance for a time interval of few seconds. During combustion process reaction temperatures are generally high, about 2000° C., while the combustion wave velocity is of the order of 0.5 cm/s. Thus, it is possible to manufacture structural assets of desired size and shape by means of proper moulds.

The step 7) involves assembling of structural assets from step 6) to build civil and/or industrial facilities on Moon, Mars and/or asteroid. Said assembling can be made by interlocking the structural assets of suitable shape. Working examples of the present invention are herein below provided for illustrative and non limiting purposes.

EXAMPLES

Example 1

Preparation of a Physical Asset According to the Present Invention 1.761 g of Ilmenite by Alfa Aesar (purity 99.8%, particle size −100 mesh, Alfa Aesar), 1.697 g of lunar regolith JSC-1A (sieved at 45 micrometers, Orbitec Technologies) and 1,092 g of aluminum powder (purity 99.5%, particle size −325 mesh, Alfa Aesar) were properly mixed. Powders were suitably compacted by means of manual hydraulic press operating at about 80 bar; in this way a cylindrical sample with diameter of 11 mm and height of 2.3 cm was prepared. Sample was introduced into the reaction chamber to perform the high-temperature self-propagating combustion under an electric ignition source made of a tungsten coil placed 2 mm above the sample surface. Vacuum conditions were applied in the reaction chamber to reach a pressure level lower than 2.6 mbar. The sample was then thermically ignited by a tungsten coil where an electrical current of 72 A, generated by potential difference of 12 V applied to the electric resistance for a maximum of 3 s flows. The combustion front velocity was able to propagate at a velocity of about 0.5 cm/s while the combustion temperature was of about 2000° C. Cooling of the final product was performed inside the reaction chamber up to room temperature.

Characterization of the final product was carried out by taking advantage of X-ray difractometry (XRD) and scanning electronic microscopy (SEM) with EDS. From these analyses the final product consisted mainly of alumina ($Al_2O_3$), spinel ($MgAl_2O_4$) and hibonite ($CaAl_{12}O_{19}$) with the presence of iron (Fe) and titanium (Ti).

Figure 2:
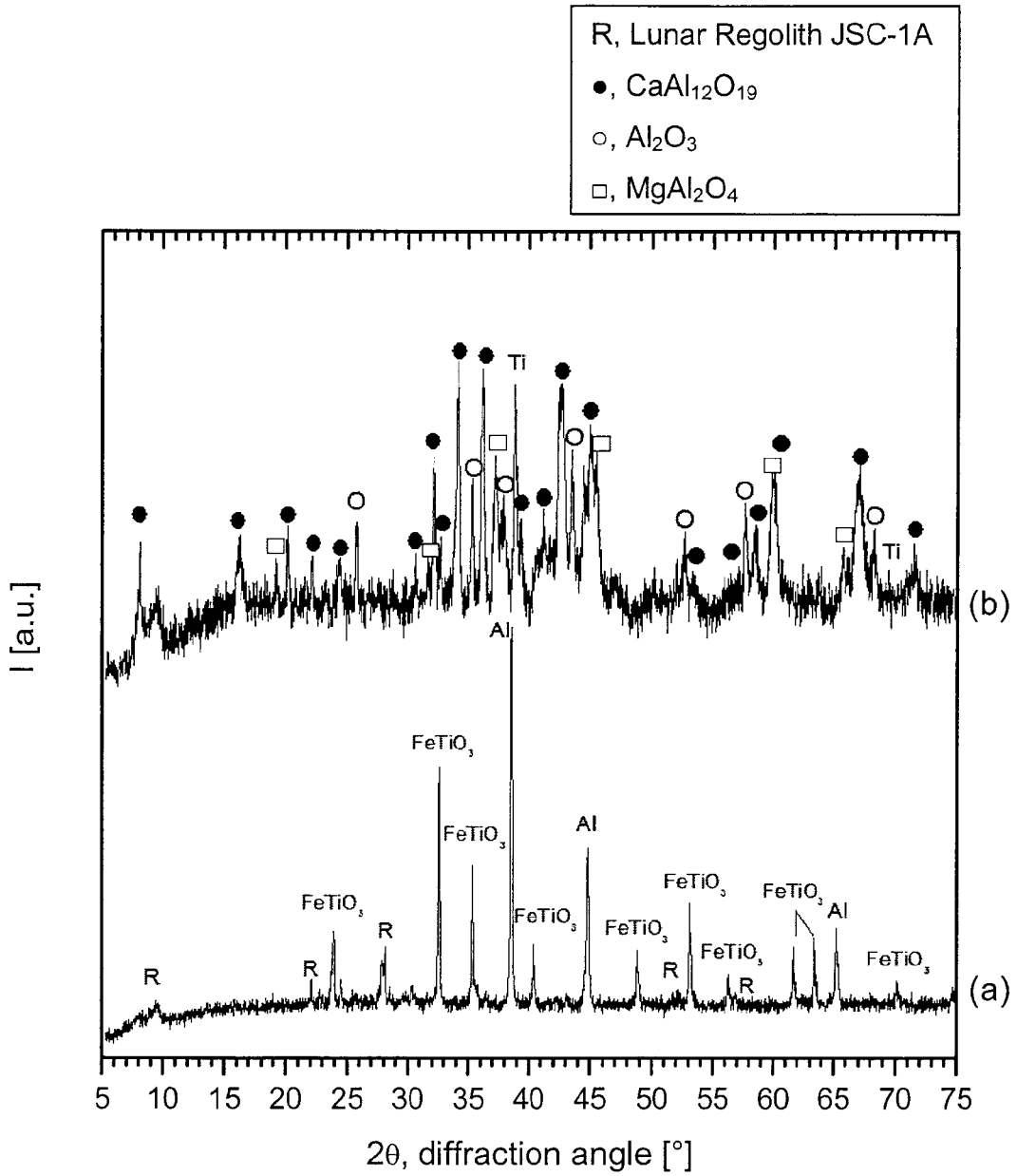
FIG. 2 shows X-ray diffraction pattern of the materials of Example 1.

FIG. 2 shows X-ray diffraction pattern of reactants and products obtained with this example. Final product appears like a solid of dark grey color with low porosity.

Example 2

Preparation of a Physical Asset According to the Present Invention 1.363 g $Fe_2O_3$ (purity +99%, particle size −5 micron, Sigma Aldrich), 1.835 g of Martian regolith JSC-1A (sieved at 45 micrometers, Orbitec Technologies) once heated for 2 hours in a oven at 600° C., and 0.602 g of aluminum powder (purity 99.5%, particle size −325 mesh, Alfa Aesar) were properly mixed. Powders were suitably compacted by means of manual hydraulic press operating at about 80 bar; in this way a cylindrical sample with diameter of 11 mm and height of 2.3 cm was prepared. Sample was introduced into the reaction chamber to perform the high-temperature self-propagating combustion under an electric ignition source made of a tungsten coil placed 2 mm above the sample surface. Vacuum conditions were applied in the reaction chamber to reach a pressure level lower than 7 mbar. The sample was then thermically ignited by a tungsten coil where an electrical current of 72 A, generated by potential difference of 12 V applied to the electric resistance for a maximum of 3 s flows. The combustion front velocity was able to propagate at a velocity of about 0.5 cm/s while the combustion temperature was of about 2000° C. Cooling of the final product was performed inside the reaction chamber up to room temperature.

Characterization of the final product was carried out by taking advantage of X-ray difractometry (XRD) and scanning electronic microscopy (SEM) with EDS. From these analyses the final product consisted mainly of alumina ($Al_2O_3$), ercinite ($FeAl_2O_4$) and iron (Fe).

Figure 3:
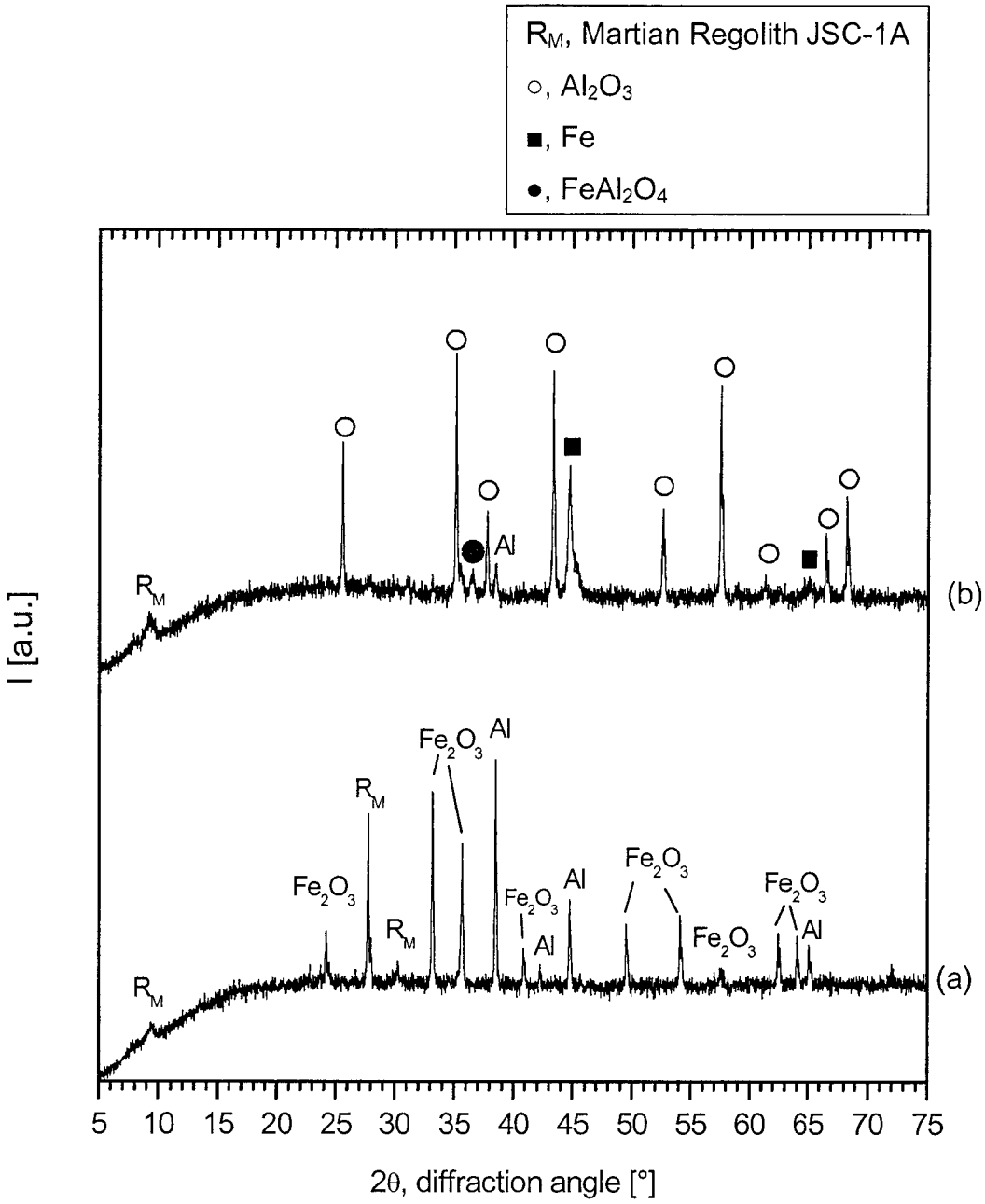
FIG. 3 shows X-ray diffraction pattern of the materials of Example 2.

FIG. 3 shows X-ray diffraction pattern of reactants and products obtained with this example. Final product appears like a solid of dark grey color with low porosity.

Example 3

Preparation of a Physical Asset According to the Present Invention 1.474 g of $Fe_2O_3$ (purity +99%, particle size −5 micron, Sigma Aldrich), 1.718 g of Martian regolith MMS (Mojave Martian Regolith) (Jet Propulsion Laboratories) once heated for 2 hours in a oven at 700° C., and 0.604 g of aluminum powder (purity 99.5%, particle size −325 mesh, Alfa Aesar) were properly mixed. Powders were suitably compacted by means of manual hydraulic press operating at about 80 bar; in this way a cylindrical sample with diameter of 11 mm and height of 2.3 cm was prepared. Sample was introduced into the reaction chamber to perform the high-temperature self-propagating combustion under an electric ignition source made of a tungsten coil placed 2 mm above the sample surface. Vacuum conditions were applied in the reaction chamber to reach a pressure level lower than 7 mbar. The sample was then thermically ignited by a tungsten coil where an electrical current of 72 A, generated by potential difference of 12 V applied to the electric resistance for a maximum of 3 s flows. The combustion front velocity was able to propagate at a velocity of about 0.5 cm/s while the combustion temperature was of about 2000° C. Cooling of the final product was performed inside the reaction chamber up to room temperature.

Figure 4:
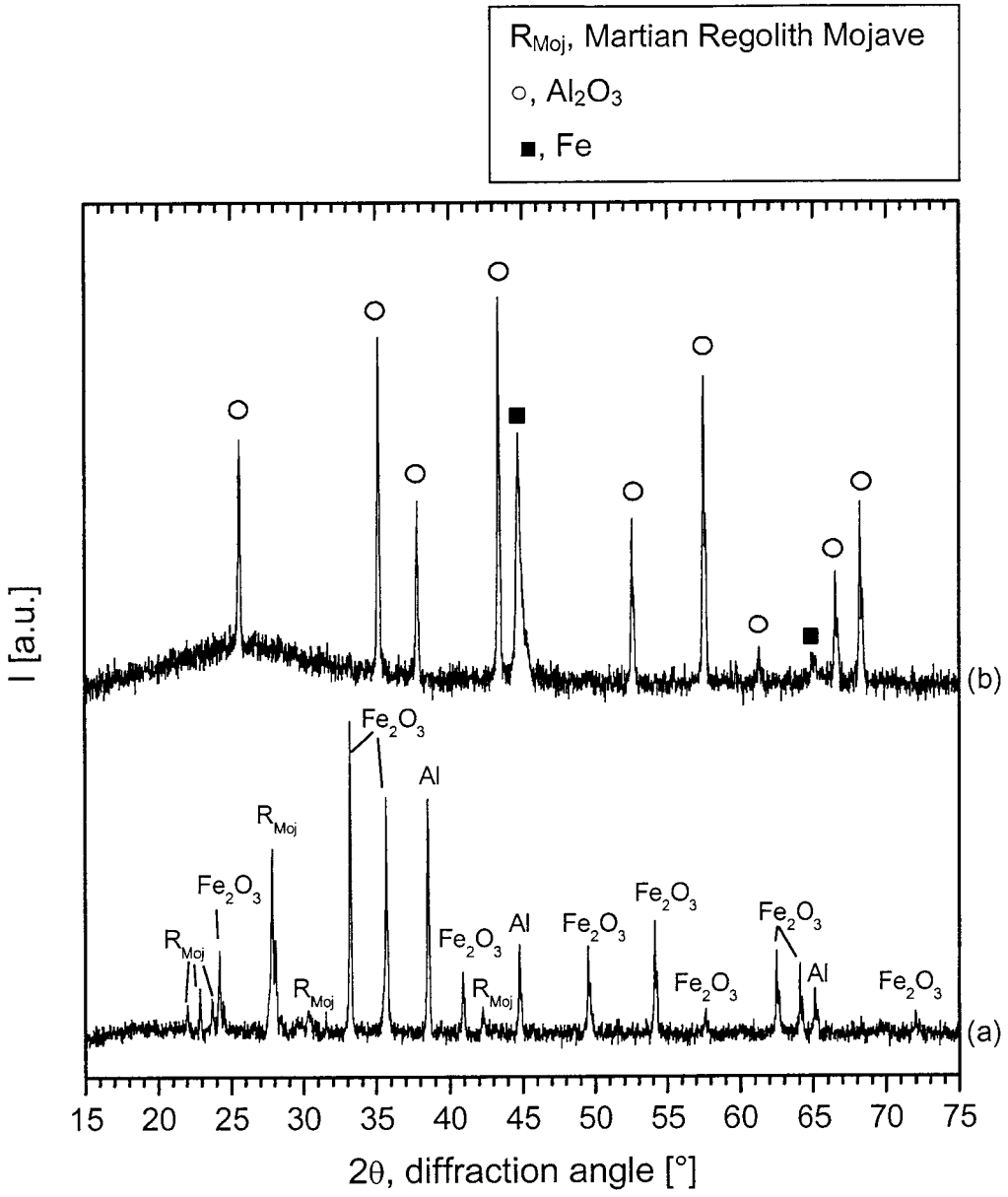
FIG. 4 shows X-ray diffraction pattern of the materials of Example 3.

Characterization of the final product was carried out by taking advantage of X-ray difractometry (XRD) and scanning electronic microscopy (SEM) with EDS. From these analyses the final product consisted mainly of alumina ($Al_2O_3$) and iron (Fe). FIG. 4 shows X-ray diffraction spectra of reactants and products obtained with this example. Final product appears like a solid of dark grey color with low porosity.

The features and advantages of the present invention are apparent from the detailed description of the invention itself and from the working example provided. In particular, such kit permits to implement the process of the invention by providing all materials and apparatus which will be employed on Moon, Mars or asteroid, thus advantageously and significantly reducing, both costs and total payload of the materials as well as time of manufacture of civil and/or industrial facilities, all typically large in a space mission. Indeed, since this invention allows to surprisingly exploit resources available in situ for the manufacturing of civil and/or industrial facilities, a space mission is surprisingly and advantageously simplified and facilitated both economically and operationally.

The invention claimed is:

1. A method for manufacturing physical assets for civil or industrial facilities on Moon, Mars or an asteroid, said method comprising:

providing a kit of materials and apparatus on at least one of Moon, Mars or the asteroid comprising:

a photovoltaic panel, an electrolyzer, a voltage transformer and a fuel cell based on a hydrogen/oxygen cycle;

an excavator;

a separator for ion bombardment comprising an ionizing electrode comprising a source of $Po^{210}$ and a static electrode, or field induced, comprising a rotor comprising of alternate ferromagnetic disks and non-magnetic material and at least one divider for particles separation;

a mixer; and a reaction chamber equipped with a sample holder and at least two electrodes, aluminum powder, a mold for confinement of a reaction mixture and an electrical resistance as a trigger;

photovoltaically generating electricity;

extracting regolith from Moon, Mars or asteroid soil by excavation;

electrostatically enriching, using the separator for ion bombardment, the Moon or asteroid regolith with ilmenite or magnetically enriching, using the field induced, the Mars regolith with iron oxides for obtaining enriched minerals;

mixing the enriched minerals with an aluminum powder to obtain a mixture;

inducing a self-propagating combustion reaction into the obtained mixture by thermal triggering using an electrical resistance to obtain physical assets of a size and a shape using a physical asset mold to define the size and the shape; and assembling the physical assets to build civil or industrial facilities.

2. The method of claim 1, wherein the mixing comprises a weight percentage of 75-78 wt % of Moon or asteroid regolith enriched in ilmenite at 40-66 wt %, and 22-25 wt % of aluminum powder.

3. The method of claim 1, wherein the mixing comprises a weight percentage of 80-85 wt % of Martian regolith enriched with 45-65 wt % of iron oxides, and 15-20 wt % of aluminum powder.

* * * * *